US010457997B2

(12) United States Patent
Singh

(10) Patent No.: US 10,457,997 B2
(45) Date of Patent: Oct. 29, 2019

(54) PROCESSING OF HOT STAMPED PARTS

(71) Applicants: MAGNA INTERNATIONAL INC., Aurora (CA); Jaswinder Pal Singh, Sterling Heights, MI (US)

(72) Inventor: Jaswinder Pal Singh, Sterling Heights, MI (US)

(73) Assignee: MAGNA INTERNATIONAL INC., Aurora (CA)

( * ) Notice: Subject to any disclaimer, the term of this patent is extended or adjusted under 35 U.S.C. 154(b) by 483 days.

(21) Appl. No.: 14/774,198

(22) PCT Filed: Feb. 21, 2014

(86) PCT No.: PCT/US2014/017595
§ 371 (c)(1),
(2) Date: Sep. 10, 2015

(87) PCT Pub. No.: WO2014/163832
PCT Pub. Date: Oct. 9, 2014

(65) Prior Publication Data

US 2016/0024608 A1 Jan. 28, 2016

Related U.S. Application Data

(60) Provisional application No. 61/778,843, filed on Mar. 13, 2013.

(51) Int. Cl.
*C21D 8/00* (2006.01)
*C21D 1/673* (2006.01)
(Continued)

(52) U.S. Cl.
CPC ..... *C21D 8/005* (2013.01); *B21D 22/022* (2013.01); *C21D 1/673* (2013.01); *C21D 6/00* (2013.01);
(Continued)

(58) Field of Classification Search
CPC ..... C21D 8/005; C21D 6/00; C21D 9/0062; B21D 22/022
See application file for complete search history.

(56) References Cited

U.S. PATENT DOCUMENTS

2008/0295563 A1 12/2008 Terziakin
2010/0018277 A1 1/2010 Hielscher
(Continued)

FOREIGN PATENT DOCUMENTS

DE 102011053118 B3 12/2012

*Primary Examiner* — Scott R Kastler
(74) *Attorney, Agent, or Firm* — Dickinson Wright PLLC

(57) ABSTRACT

A method of manufacturing a steel part including hot stamping followed by trimming, piercing, or flanging, without delayed fracture and without the need for annealing, is provided. The method includes heating a blank formed of a steel material, forming the blank between a pair of dies, and quenching the blank. The temperature drop in select areas of the blank is reduced, which limits the amount of martensite formed in the select areas, but allows martensite to form in other areas. The dies can be formed with modified materials or modified cooling channels to limit the amount of martensite formed in the select areas of the blank. The select areas are softer than the other areas and can be subsequently trimmed, pierced, or flanged without the delayed fractures.

25 Claims, 3 Drawing Sheets

(51) Int. Cl.

| | |
|---|---|
| ***B21D 22/02*** | (2006.01) |
| ***C21D 6/00*** | (2006.01) |
| ***C21D 9/00*** | (2006.01) |
| ***C22C 38/00*** | (2006.01) |

(52) U.S. Cl.
CPC ..... *C21D 9/0062* (2013.01); *C22C 38/00* (2013.01); *C21D 2221/00* (2013.01)

(56) References Cited

U.S. PATENT DOCUMENTS

| | | | | |
|---|---|---|---|---|
| 2011/0068519 | A1 | 3/2011 | Kwon et al. | |
| 2012/0017744 | A1* | 1/2012 | Nilsson | B21D 28/10 83/861 |
| 2012/0186705 | A1 | 7/2012 | Sikora et al. | |
| 2014/0190234 | A1 | 7/2014 | Löker | |
| 2016/0024608 | A1* | 1/2016 | Singh | C21D 1/673 148/653 |

* cited by examiner

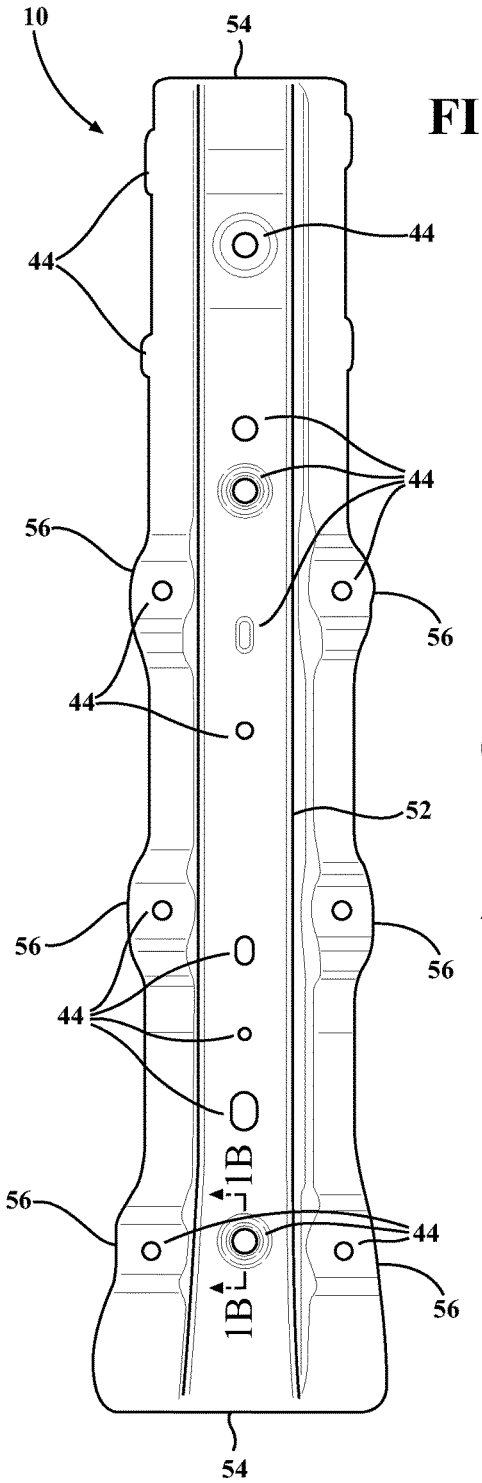
FIG. 1
FIG. 2
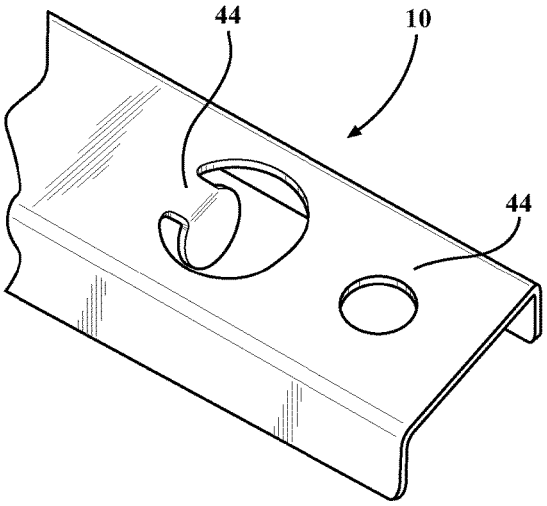

PROCESSING OF HOT STAMPED PARTS

CROSS-REFERENCE TO PRIOR APPLICATIONS

This U.S. National Stage patent application claims the benefit of PCT International Patent Application Serial No. PCT/US2014/017595 filed Feb. 21, 2014 entitled "Processing Of Hot Stamped Parts," which claims the benefit of U.S. Provisional Patent Application Ser. No. 61/778,843 filed Mar. 13, 2013, entitled "Processing Of Hot Stamped Parts," the entire disclosures of the applications being considered part of the disclosure of this application and hereby incorporated by reference.

BACKGROUND OF THE INVENTION

1. Field of the Invention

The invention relates generally to hot formed parts, as well as apparatuses and methods for manufacturing the hot formed parts.

2. Related Art

Hot formed parts are oftentimes manufactured by heating a blank formed of steel or a steel alloy to a temperature of at least 900° C., and immediately stamping the blank between two dies. The stamping step typically includes quenching the formed blank at the bottom of the stamping stroke, when the dies are pressed together. The temperature reduction of the blank during the quenching step causes martensite to form throughout the steel or steel alloy, which is also referred to as a martensitic phase transformation. Although the martensitic phase transformation provides increased strength, it can lead to problems when the hot formed part is subsequently trimmed. For example, the hot formed part oftentimes experiences residual stress and delayed fractures after mechanical trimming.

To remove residual stresses and prevent delayed fractures in the hot formed part, the hot formed part can be post annealed after the quenching step and before the trimming step. However, the post annealing process leads to geometric distortion of the hot formed part and requires significant capital investments.

SUMMARY OF THE INVENTION

The invention provides a method of forming a part including at least one of cutting and deforming, without delayed fractures and without the need for post annealing, prior to the cutting or deforming step. The method comprises the steps of: providing a blank formed of a steel material, heating the blank to a predetermined temperature, and forming the heated blank to a predetermined geometry. The forming step includes quenching the blank to form martensite in the blank, and the quenching step includes limiting the amount of martensite formed in at least one select area of the blank. The method further comprises at least one of cutting and deforming the at least one select area of the blank.

The invention also provides an apparatus for forming a part. The apparatus includes a pair of dies for forming and quenching a blank formed of a steel material. At least one of the dies includes at least one modification for limiting formation of martensite in at least one select area of the blank during the quenching step.

The invention further provides a formed part. The part includes a body formed of a steel material. The body includes at least one select area with less martensite than other areas of the body, and the at least one select area is cut and/or deformed.

BRIEF DESCRIPTION OF THE DRAWINGS

Other advantages of the present invention will be readily appreciated, as the same becomes better understood by reference to the following detailed description when considered in connection with the accompanying drawings wherein:

FIG. 1 is a top view of an exemplary hot formed part;

FIG. 2 is a perspective view of a portion of another exemplary hot formed part including a tab;

DETAILED DESCRIPTION

Figure 3:
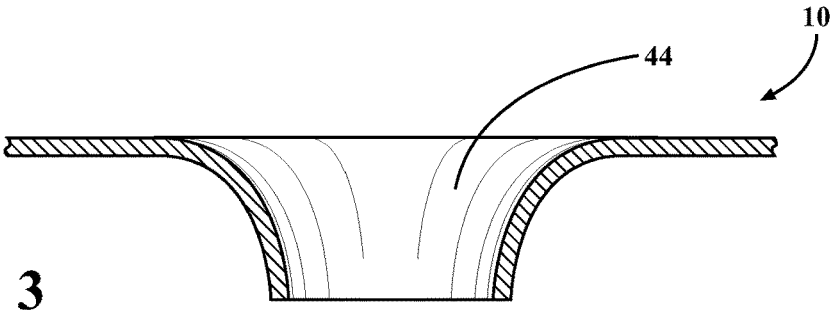
FIG. 3 is a side cross-sectional view of a portion of yet another exemplary hot formed part include a flanged hole.
Figure 4:
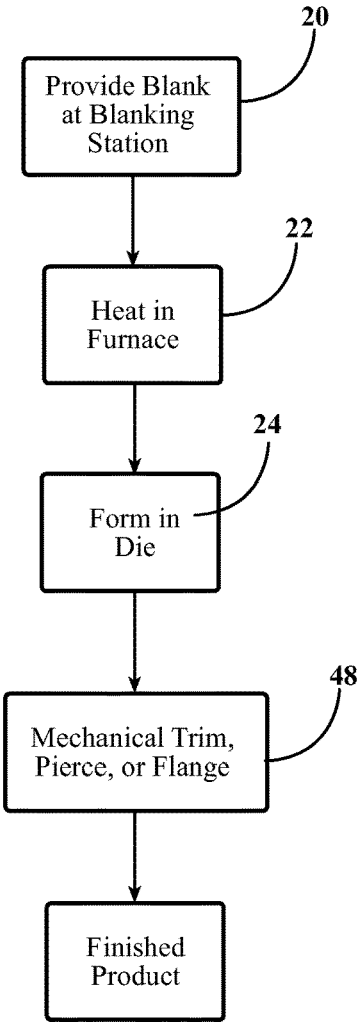
FIG. 4 is a schematic view of an exemplary method of manufacturing a hot formed part.

The invention provides a hot formed part 10 which has been cut or deformed, for example a part 10 which has been hot stamped, and then trimmed, pierced, or flanged. The hot formed part 10 is typically used as a body pillar, rocker, column, or beam, such as a roof rail, bumper, or door intrusion beam of an automotive vehicle, but it can be used in another application. FIG. 1 is a top view of the hot formed part 10 according to one exemplary embodiment, and FIGS. 2 and 3 are portions of hot formed parts 10 according to other exemplary embodiments. FIG. 4 is a schematic view of an exemplary method of manufacturing the hot formed part 10.

The method of manufacturing the hot formed part 10 first includes providing a blank 36. The blank 36 is typically provided at a blanking station 20 and is formed of a steel material, such as any type of steel or a steel alloy. The geometry of the blank 36 depends on the desired geometry and application of the hot formed part 10. If the hot formed part 10 is used as a pillar, rail, bumper, or beam, then the blank 36 is elongated between opposite ends.

Next, the blank 36 is transferred to a furnace 22 where it is heated to a predetermined temperature sufficient for hot forming. The predetermined temperature depends on the type of steel material of the blank 36, the geometry of the blank 36, the desired geometry of the hot formed part 10, and possibly other factors. In one exemplary embodiment, the blank 36 is heated to a temperature of at least 900° C., which is high enough to form austenite in the steel or steel alloy.

Figure 5:
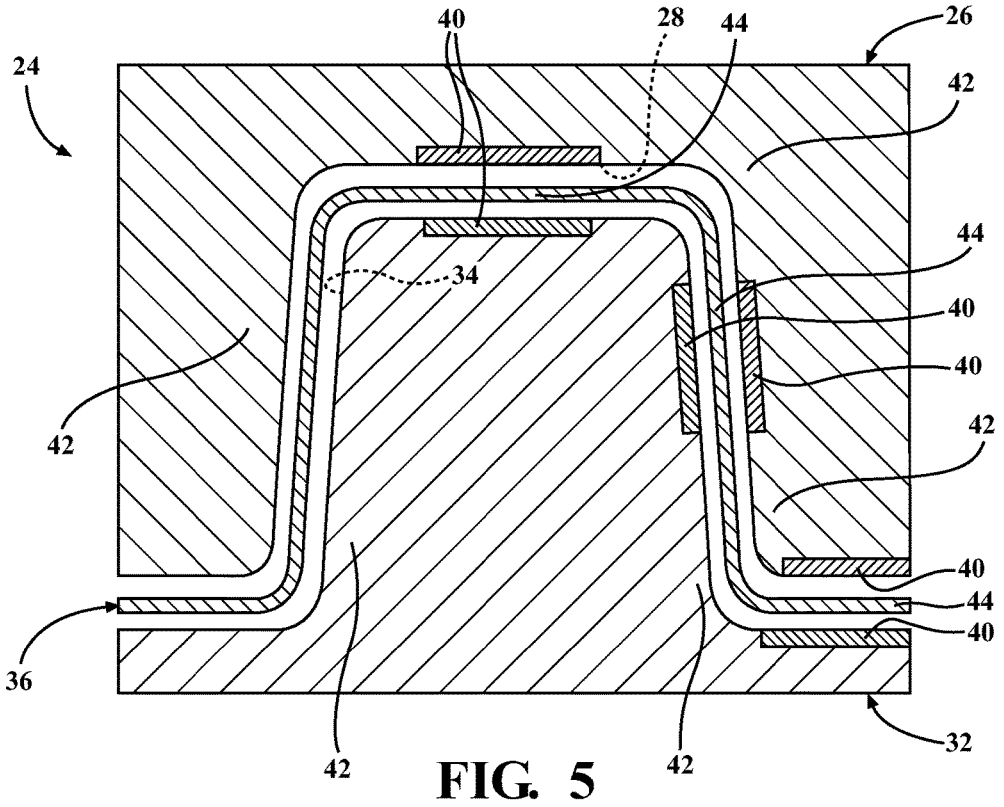
FIG. 5 is an exemplary pair of dies used in the hot forming method of FIG. 4.
Figure 6:
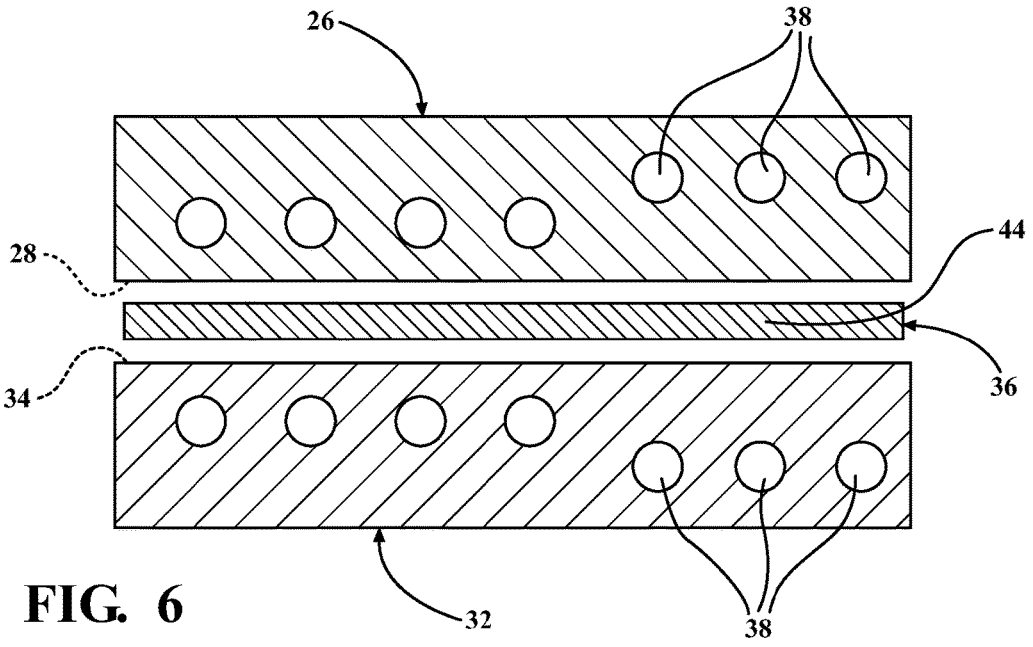
FIG. 6 is another exemplary pair of dies used in the hot forming method of FIG. 4.

Once the blank 36 reaches the predetermined temperature sufficient for hot forming, the heated blank 36 is quickly transferred to a die or stamping apparatus 24. FIGS. 5 and 6 illustrate examples of the stamping apparatus 24 receiving the heated blank 36. The stamping apparatus 24 includes an upper die 26 presenting an upper stamping surface 28 and a lower die 32 presenting a lower stamping surface 34. The blank 36 is disposed between the two stamping surfaces 28, 34. The shape of the upper die 26 and lower die 32 varies depending on the desired geometry of the hot formed part 10 to be formed. The upper and lower dies 26, 32, are typically formed of steel, but can be formed of other materials. The upper and lower dies 26, 32 also typically include a plurality of cooling channels 38 spaced from the stamping surfaces 28, 34, as shown in FIG. 6.

The stamping apparatus 24 is used to conduct the forming step. The forming step typically begins immediately or shortly after the blank 36 is disposed between the upper and lower dies 26, 32, and while the blank 36 is still at a temperature of at least 900° C., or close to the predetermined temperature achieved in the furnace 22. During the forming step, the upper and lower dies 26, 32 are pressed together to stamp or otherwise form the blank 36 to the desired geometry. The forming step is typically a hot stamping step, which includes stamping the hot blank 36 between the upper and lower dies 26, 32 of the stamping apparatus 24 to achieve the desired geometry, specifically by engaging the hot blank 36 with the upper and lower dies 26, 32 and applying pressure to the hot blank 36 using at least one of the upper and lower dies 26, 32. Alternatively, the forming step could comprise another type of forming, different from stamping. In the exemplary embodiment, the blank 36 is heated to a temperature of at least 900° C. so that austenite is present in the steel or steel alloy of the blank 36 during the forming step, and the forming step includes stamping the blank 36 to achieve the desired geometry. The blank 36 can be formed to various different and complex geometries, depending on the desired application of the hot formed part 10.

At the bottom of the forming stroke, when the upper and lower dies 26, 32 are pressed together, water or another cooling fluid flows through the cooling channels 38 of the dies 26, 32 and the formed blank 36 is quenched. This quenching step causes a phase transformation in the steel material and increases the strength of the steel material. During the quenching step of conventional hot stamping processes, the steel material reaches a temperature low enough to form martensite throughout the steel material. Although the martensite provides high strength, it also leads to residual stress and delayed fractures when the hot formed part 10 is subsequently cut or deformed.

In the process of the present invention, at least one of the upper die 26 and the lower die 32, but preferably both the upper and lower dies 26, 32, are modified to significantly reduce or prevent martensite formation in select areas 44 of the blank 36 where the subsequent trimming, piercing, or flanging will occur. The modifications to the upper and lower dies 26, 32 reduce the temperature drop in the select areas 44 of the blank 36 during the quenching step, which prevents or limits martensite formation in those select areas 44. In the remaining areas of the blank surrounding or adjacent the select areas 44, the martensite still forms during the quenching step, as in the conventional process. Therefore, the method of the present invention still provides a high strength part 10 while reducing residual stress and preventing delayed fractures.

After the quenching step, the steel material of the select areas 44 includes at least one of ferrite, pearlite, bainite, and cementite, which experience less residual stress and delayed fractures when cut or deformed, compared to martensite. Although the select areas 44 of the blank 36 may still include small martensitic phases in the molecular structure of the steel or steel alloy, the amount of martensite formed in the select areas 44 is significantly less than the amount of martensite formed in the other areas of the blank 36 surrounding, adjacent, or along the select areas 44. The design of the stamping apparatus 24 allows the other areas of the blank 36, where no subsequent cutting or deforming will occur, to still undergo the martensite phase transformation during the quenching step to achieve the increased strength.

In one embodiment, as shown in FIG. 5, the material of the upper and lower dies 26, 32 is modified to prevent the martensitic phase transformation in the select areas 44 of the blank 36. In this embodiment, the material of the upper and lower dies 26, 32 includes low thermal conductivity regions 40 and high thermal conductivity regions 42. The low thermal conductivity regions 40 are formed of a material having a lower thermal conductivity than the material of the high thermal conductivity regions 42. The low thermal conductivity regions 40 of the die 26, 32 align with the select areas 44 of the blank 36 that will be subject to cutting or deforming. When the low thermal conductivity regions 40 of the dies 26, 32 engage the blank 36, less heat is transferred from the blank 36 to the dies 26, 32 than when the high thermal conductivity regions 42 engage the blank 36. During the quenching step, the select areas 44 of the formed blank 36 experience slower cooling and less temperature reduction than the other areas of the blank 36. Therefore, less martensite forms in the steel material of the select areas 44 compared to the other areas of the blank 36, which are quenched to a lower temperature and experience a significant amount of martensitic phase transformation. The thermal conductivities of the die regions 40, 42 and the quenching time and temperature can be adjusted such that the select areas 44 of the blank 36 include a very limited amount of martensite, while the remaining areas include a greater amount of martensite.

In another embodiment, as shown in FIG. 6, the location of the cooling channels 38 in at least one of the upper and lower dies 26, 32 is modified to prevent the martensitic phase transformation in the select areas 44 of the blank 36. For example, one or more of the cooling channels 38 can be spaced a greater distance from the stamping surface 28, 34 than the other cooling channels 38. The spaced cooling channels 38 align with the select areas 44 of the blank 36 that will be subject to cutting or deforming. During the quenching step, the select areas 44 experience slower cooling and less temperature reduction. Therefore, the select areas 44 experience less martensitic phase transformation than the other areas of the blank 36, which are closer to the cooling channels 44 and experience a significant martensitic phase transformation. The location of the cooling channels 38 and the quenching time and temperature can be adjusted such that the select areas 44 of the blank 36 experience very limited martensitic phase transformation, while the remaining areas include a greater amount of martensitic phase transformation.

As stated above, the select areas 44 are located in areas of the formed blank 36 subject to subsequent cutting or deforming. The cutting step typically includes trimming or piercing, and the deforming step typically includes flanging. For example, the select areas 44 can be located along the edges of the blank 36 for trimming. The select areas 44 can also be located in areas spaced from one another along the length of the blank 36 for piercing.

After forming and quenching the blank 36 between the dies 26, 32, the hot formed part 10 is provided. The process then includes at least one of cutting and deforming the select areas 44 of the hot formed part 10 to achieve a desired geometry. The cutting and/or deforming steps can occur in the die or stamping apparatus 24, such as between the dies 26, 32. Alternatively, the hot formed part 10 can be removed from the stamping apparatus 24 and transferred to a second forming apparatus 48 outside of the dies 26, 32 for the cutting and/or deforming steps. As previously discussed, the steel material of the select areas 44 includes no or little martensite, while the remaining areas of the hot formed part 10 include a greater amount of martensite. The select areas 44 include one or more of ferrite, pearlite, bainite, and cementite, which are softer and have less residual stress compared to martensite. Accordingly, there is no need to anneal the hot formed part 10 prior to the cutting or deforming because the select areas 44 already have a limited amount martensite and are soft enough to trim, pierce, or flange without experiencing delayed fractures. Preferably, the cutting and/or deforming occurs only in the at least one select area 44 of the hot formed part 10, and the remaining areas of the hot formed part 10 outside of the select areas 44 are not cut or deformed.

The finished hot formed part 10 comprises a steel body including the select areas 44 of limited or no martensite, which have been cut or deformed. Typically, the select areas 44 of the body of the hot formed part 10 each include at least one of ferrite, pearlite, bainite, and cementite. The select areas 44 of the body are softer than the other areas of the body, which include martensite. The hot formed part 10 can comprise a complex geometry, like the exemplary hot formed part 10 of FIG. 1. The hot formed part 10 of FIG. 1 includes a ledge 52 extending longitudinally between opposite ends 54, and a plurality of ribs 56 spaced from one another and extending transverse to the ledge 52. The hot formed part 10 may also present an inverted U-shaped cross-section, as shown in FIG. 2.

In FIG. 1, several select areas 44 of the hot formed part 10 are identified. A couple of the select areas 44 identified are located along the perimeter edges of the hot formed part 10, which is trimmed to a desired shape. The other identified select areas 44 are located along the ledge 52 or the ribs 56, and those select areas 44 are pierced to present a hole. The ledge 52 can include a plurality of the select areas 44 spaced from one another between the opposite ends 54, and the ribs 56 can include select areas 44 on each side of the ledge 52. The holes can be formed with a tab which is bent inwardly, as shown in FIG. 2. The holes of the part 10 can also be flanged, as shown in FIG. 3. Preferably, the higher strength martensite-containing areas of the hot formed part 10 surrounding or adjacent the select areas 44 are not cut or deformed.

As stated above, the hot formed part 10 manufactured according to the method of the present invention experiences less delayed fractures, compared to hot formed parts formed according to processes of the prior art. The select areas 44 of the hot formed part 10 subject to cutting or deforming include little or no martensite and thus are softer, while the remaining areas of the hot formed part 10 include a significant amount of martensite and provide sufficient strength for automotive applications.

Obviously, many modifications and variations of the present invention are possible in light of the above teachings and may be practiced otherwise than as specifically described while within the scope of the invention.

The invention claimed is:

1. A method of forming a part, comprising the steps of:

providing a blank delimited by at least one peripheral edge and formed of a steel material;

heating the blank to a predetermined temperature;

forming the heated blank to a predetermined geometry;

the forming step including quenching the blank to form martensite in the blank;

the quenching step including limiting the amount of martensite formed in at least one select area completely spaced from the at least one peripheral edge of the blank by other areas of the blank having more martensite than the at least one select area; and forming at least one hole in the at least one select area of the blank.

2. The method of claim 1 wherein the quenching step includes forming martensite in the other areas of the blank surrounding and adjacent to the at least one select area, and forming less martensite in the at least one select area than the other areas of the blank.

3. The method of claim 1 wherein the step of forming the at least one hole includes at least one of trimming and piercing.

4. The method of claim 1 wherein the predetermined temperature of the heating step is at least 900° C. and the forming step includes stamping the heated blank in a stamping apparatus.

5. The method of claim 1 wherein the quenching step includes cooling the at least one select area of the blank at a slower rate than the other areas of the blank surrounding the at least one select area.

6. The method of claim 1 wherein the quenching step includes forming at least one of ferrite, pearlite, bainite, and cementite in the at least one select area of the blank.

7. The method of claim 1 wherein the quenching step is conducted in a die including a stamping surface, and the at least one modification includes a low thermal conductivity region along a portion of the stamping surface or a plurality of cooling channels spaced from the stamping surface, wherein the low thermal conductivity region is formed of a material having a lower thermal conductivity than material of other regions disposed along the stamping surface, and the cooling channels include at least one of the cooling channels being spaced a greater distance from the stamping surface than the other cooling channels.

8. The method of claim 1 further comprising:

providing an apparatus including a pair of dies;

conducting the forming and quenching steps between the dies, wherein at least one of the dies includes at least one modification to limit the formation of martensite in the blank during the quenching step;

identifying the at least one select area of the blank subsequently subjected to the step of forming the hole; and aligning the at least one select area of the blank with the at least one modification.

9. The method of claim 8 wherein the predetermined temperature of the heating step is at least 900° C.;

the forming step including forming the blank while the blank is at a temperature of at least 900° C.;

the quenching step includes cooling the at least one select area of the blank at a slower rate than other areas of the blank adjacent the at least one select area;

the quenching step includes forming martensite in other areas of the blank adjacent the at least one select area, and forming less martensite in the at least one select area than the other areas of the blank;

the quenching step includes forming at least one of ferrite, pearlite, bainite, and cementite in the at least one select area of the blank;

the quenching step is conducted in a die including a stamping surface, and the at least one modification includes a low thermal conductivity region along a portion of the stamping surface or a plurality of cooling channels spaced from the stamping surface, wherein the low thermal conductivity region is formed of a material having a lower thermal conductivity than material of other regions disposed along the stamping surface, and the cooling channels include at least one of the cooling channels being spaced a greater distance from the stamping surface than the other cooling channels;

the step of forming the at least one hole includes at least one of trimming and piercing the at least one select area; and no annealing step is conducted between the quenching step and the step of forming the at least one hole.

10. The method of claim 8 wherein the die includes a stamping surface, and the at least one modification includes a low thermal conductivity region along a portion of the stamping surface, the low thermal conductivity region being formed of a material having a lower thermal conductivity than material of other regions disposed along the stamping surface.

11. The method of claim 8 wherein the die includes a stamping surface and a plurality of cooling channels spaced from the stamping surface, and the at least one modification includes one of the cooling channels being spaced a greater distance from the stamping surface than the other cooling channels.

12. The method of claim 1 including no annealing step between the quenching step and the step of forming at least one hole.

13. The method of claim 1 wherein the predetermined geometry of the heated blanks forms a pillar, rocker, column, beam, roof rail, or bumper of an automotive vehicle.

14. A hot formed part, comprising:

a body formed of a steel material;

said body including at least one select area with less martensite than other areas of said body completely surrounding the at least one select area; and said body including at least one hole in said at least one select area.

15. An apparatus for forming a part according to claim 14, comprising:

a pair of dies for forming and quenching a blank formed of a steel material;

at least one of said dies including at least one modification for limiting formation of martensite in at least one select area of the blank during the quenching step; and the at least one modification contained within a peripheral edge of the associated die such that the at least one select area is disposed within a peripheral edge of the blank.

16. The apparatus of claim 15 wherein at least one of said dies includes a stamping surface, and said at least one modification includes a low thermal conductivity region disposed flush with said stamping surface, and said low thermal conductivity region is formed of a material having a lower thermal conductivity than material of other regions disposed along said stamping surface.

17. The apparatus of claim 15 wherein at least one of said dies includes a stamping surface and a plurality of cooling channels spaced from said stamping surface, and said at least one modification includes one of said cooling channels being spaced a greater distance from said stamping surface than the other cooling channels.

18. The hot formed part of claim 14 wherein said body is cut to form at least one hole in said at least one select area.

19. The hot formed part of claim 14 wherein said at least one select area includes at least one of ferrite, pearlite, bainite, and cementite.

20. The hot formed part of claim 14 wherein said hot formed part is a pillar, rocker, column, beam, roof rail, or bumper of an automotive vehicle.

21. The method of claim 7 wherein the at least one modification includes at least one low thermal conductivity region along the stamping surface for forming the metal blank.

22. The method of claim 21 wherein the at least one low thermal conductivity region includes a plurality of low thermal conductivity regions of at least one of varying size and shape.

23. The method of claim 22 including forming a plurality of the holes of varying size and shape.

24. The method of claim 23 wherein the step of forming a plurality of the holes includes forming at least one hole with a flange.

25. The method of claim 21 wherein the at least one low thermal conductivity region includes a low thermal conductivity region disposed in the stamping surface on either side of the blank and located to contact the same select area of the blank from either side.

* * * * *